US009738444B1

(12) United States Patent
Uffner et al.

(10) Patent No.: US 9,738,444 B1
(45) Date of Patent: Aug. 22, 2017

(54) COMMERCIAL GRADE WHEELED REFUSE RECEPTACLE WITH LID

(71) Applicant: Suncast Technologies, LLC, Palm Beach Gardens, FL (US)

(72) Inventors: Michael Uffner, Naperville, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 15/012,909

(22) Filed: Feb. 2, 2016

(51) Int. Cl.
*B65F 1/14* (2006.01)
*B65F 1/16* (2006.01)

(52) U.S. Cl.
CPC ..... *B65F 1/1473* (2013.01); *B65F 1/1452* (2013.01); *B65F 1/1646* (2013.01)

(58) Field of Classification Search
CPC .. B65F 1/00; B65F 1/14; B65F 1/1452; B65F 1/1468; B65F 1/1473; B65F 1/1646
See application file for complete search history.

(56) References Cited

U.S. PATENT DOCUMENTS 3,096,900 A 7/1963 Breneman
3,804,277 A * 4/1974 Brown ..... B65F 1/122 414/303
4,351,539 A 9/1982 Rodolakis
4,450,976 A * 5/1984 Snyder ..... B65F 1/1468 220/844
D292,638 S 11/1987 Carville
4,749,101 A 6/1988 Durkan, Jr.
4,917,257 A * 4/1990 Edelhoff ..... B65F 1/122 220/660
D315,626 S 3/1991 Delmerico et al.
D319,905 S 9/1991 Hotchkiss
D323,912 S * 2/1992 Delmerico ..... D34/5
D323,914 S 2/1992 Doxey et al.
5,088,750 A * 2/1992 Beese ..... B65F 1/02 220/908
D326,342 S 5/1992 Doxey et al.
5,129,535 A 7/1992 Hradisky
D329,930 S 9/1992 Delmerico et al.
5,165,564 A * 11/1992 Prout ..... B65F 1/1468 220/229
5,167,351 A * 12/1992 Prout ..... B65F 1/1468 220/840
D333,716 S 3/1993 Bird et al.
(Continued)

*Primary Examiner* — Hau Phan
*Assistant Examiner* — Jacob Meyer
(74) *Attorney, Agent, or Firm* — McHale & Slavin, P.A.

(57) ABSTRACT

A refuse receptacle is disclosed, having a body with an upper and a lower portion, the upper portion having a top rim forming a gusset with a vertical wall and a horizontal wall, the lower portion having a bottom side with a base rim. On the back side of the upper portion is a handle attached to the body of the receptacle. The handle is attached to the upper portion by at least one projecting sidewall. A lid is included, having a convex upper surface and two sets of opposing sidewalls. The opposing sidewalls correspond with the top rim of the body. The lid includes at least one projection to attach to the handle with a securing plate and fastener. The lower portion includes a drainage plug so that liquids within the body can be easily drained. A pair of wheels are connected by an axle and housed within wheel recesses.

14 Claims, 10 Drawing Sheets

(56) References Cited

U.S. PATENT DOCUMENTS 5,193,708 A * 3/1993 Prout ..... B65F 1/1468 220/840
5,195,648 A * 3/1993 Harris ..... B65D 43/165 16/253
5,261,562 A * 11/1993 Prout ..... B65F 1/1468 220/771
D343,267 S 1/1994 Craft et al.
D351,704 S 10/1994 Breen
5,356,027 A * 10/1994 Craft ..... B65F 1/1646 16/257
D355,514 S 2/1995 Breen
D355,741 S * 2/1995 Craft ..... D34/1
D360,724 S 7/1995 Breen et al.
5,447,251 A * 9/1995 Taylor ..... B65F 1/004 220/254.6
D368,563 S 4/1996 Brightbill et al.
D370,107 S 5/1996 Brightbill et al.
5,547,104 A * 8/1996 Parker ..... B65F 1/12 220/769
D376,884 S 12/1996 Presnell et al.
5,641,090 A * 6/1997 Kowalski ..... B65D 21/0219 206/508
D386,866 S 11/1997 Craft et al.
D391,728 S 3/1998 Delmerico
D391,729 S 3/1998 Delmerico
5,743,542 A * 4/1998 Mast ..... B65F 1/1473 280/43
5,758,888 A 6/1998 Burgan et al.
5,776,405 A * 7/1998 Prout ..... B29C 41/003 220/675
D400,331 S 10/1998 Rausch
D405,576 S 2/1999 Rausch
5,865,338 A 2/1999 Conn
D420,479 S 2/2000 Delmerico
6,276,557 B1 * 8/2001 Wysocki ..... B65F 1/02 220/608
D448,535 S 9/2001 Delmerico
6,328,320 B1 * 12/2001 Walski ..... B65F 1/1468 220/908
D458,724 S 6/2002 Delmerico
6,415,495 B1 7/2002 Delmerico et al.
6,471,221 B1 * 10/2002 McGarry ..... B65F 1/068 220/772
D465,312 S 11/2002 Perelli et al.
D471,336 S * 3/2003 Tuduri ..... D34/5
D474,317 S * 5/2003 Tuduri ..... D34/1
D474,318 S 5/2003 Van Landingham, Jr. et al.
D495,845 S 9/2004 Lauer
D521,204 S 5/2006 Lauer
7,100,791 B2 * 9/2006 Berger ..... B65F 1/122 220/380
D578,265 S 10/2008 Presnell
D594,595 S 6/2009 Catron et al.
7,597,361 B2 * 10/2009 Theilen ..... A01G 25/092 285/139.2
7,712,623 B2 5/2010 Wentz et al.
7,766,186 B1 * 8/2010 Brown ..... B65F 1/02 220/772
8,066,144 B2 11/2011 McNamara et al.
8,096,565 B2 * 1/2012 Meers ..... B65F 1/02 220/671
8,186,921 B2 * 5/2012 Lowman ..... F01M 11/0408 184/1.5
8,328,240 B2 * 12/2012 Stone ..... F16L 41/14 285/139.1
8,485,382 B2 * 7/2013 Raghunathan ..... B65F 1/1468 220/318
8,714,404 B2 * 5/2014 Raghunathan ..... B65F 1/1468 220/759
8,757,428 B2 6/2014 Daudelin
8,807,381 B2 8/2014 Wentz et al.
8,807,579 B2 * 8/2014 Lin ..... B62B 1/16 280/47.131
8,844,741 B2 9/2014 Perelli et al.
8,869,437 B2 * 10/2014 Robl ..... E02F 3/3618 37/468
8,919,791 B2 * 12/2014 Foster ..... B62B 1/00 280/43
8,973,927 B2 * 3/2015 Belanger ..... B62B 3/0643 280/47.17
9,027,778 B1 5/2015 Slawinski, Jr.
9,050,995 B1 6/2015 Montean
9,371,181 B2 * 6/2016 Connor ..... B65F 1/122
2003/0106898 A1 6/2003 Kennedy et al.
2004/0178198 A1 9/2004 Lauer et al.
2006/0196879 A1 9/2006 Chochinov et al.
2007/0210546 A1 9/2007 Presnell et al.
2008/0029108 A1 2/2008 Catron et al.
2008/0135557 A1 * 6/2008 Williams ..... B65F 1/1468 220/288
2008/0246239 A1 * 10/2008 Connor ..... B65F 1/122 280/47.26
2009/0084794 A1 * 4/2009 Vaiana ..... B65F 1/1468 220/495.06
2013/0234409 A1 * 9/2013 Lin ..... B62B 1/16 280/47.26
2014/0217688 A1 * 8/2014 Miller ..... B62B 1/16 280/47.26
2014/0367292 A1 * 12/2014 Bonello ..... B65F 1/14 206/459.1
2016/0227748 A1 * 8/2016 Keller ..... A01K 63/006

* cited by examiner

COMMERCIAL GRADE WHEELED REFUSE RECEPTACLE WITH LID

FIELD OF THE INVENTION

This invention relates generally to a refuse receptacle and, in particular, to a blow molded utility refuse receptacle having an injection molded handle designed to securely lock to the body of the refuse receptacle during the formation of the receptacle body, and designed to mate with a structural foam-injection molded wheeled dolly.

BACKGROUND OF THE INVENTION

Receptacles, or containers, for refuse have a variety of useful applications and are available in a number of different sizes. For example, large receptacles of 44 or 55 gallons are commonly used for disposal of trash, grass, leaves, and other materials. These large sizes of trash receptacles can be difficult to move as a person attempts to move the receptacle to a dumpster or other place where the contents of the receptacle can be emptied.

Commercial refuse receptacles, however, generally come in cylindrical shapes without attached wheels. When these need to be moved, they are often dragged across the ground, often on the corner to decrease friction and allow them to be dragged with less effort. Dragging these receptacles on a corner can wear down the plastic that forms the body of the receptacle and lead to holes or cracking over time. This can also lead to excess stress on the handles and upper rim of the receptacle, which can lead to wear and cracking.

Alternatively, dollies have been employed to allow for easier transportation of refuse containers. Common dollies employ a variant of a "bayonet" or screw attachment design. In this type of design, the container is placed onto the dolly, or the container is inverted and the dolly is placed onto the container, and the mating bayonet flights or threads between the container and dolly are engaged. The dolly and container are then rotated with respect to one another until the dolly and container have been drawn up snugly against one another.

If the container is not inverted, a user must place the container upright on the dolly and grasp the dolly between their feet, and then rotate the container to tighten the container down. Often times a user cannot be certain that the engagement has been successfully accomplished or is sufficiently tight to avoid a disastrous and unexpected separation of the dolly from the container.

Alternatively, a user must bend down and hold the dolly with one hand while attempting to rotate the container with the other hand. This exposes the user to the accumulated dirt and other contaminants on the dolly, and again, cannot be accomplished with absolute certainty that the engagement was successful. For users with physical limitations, such a procedure can be impossible.

Some receptacles come with attached wheels to allow a person to wheel the receptacle to the curb or other place where it can be picked up. These are commonly used at homes where trash and recycling containers are filled with refuse from the home and then wheeled to the curb once or twice a week so that they can be emptied by city waste management. Various iterations of these receptacles are known in the art.

Receptacles are commonly manufactured by extrusion or injection blow molding, injection molding, and rotational molding. Extrusion blow molding is the easiest and cheapest method for making hollow plastic receptacles. However, blow molding typically does not allow for the formation of durable handles that can withstand heavier weights when grasped. Injection molding, on the other hand, allows for the creation of more durable handles that can be made as part of the receptacle body. However, the injection molding process is more costly and takes more time.

Commercial waste receptacles are also designed with wheels, allowing for easy transportation from a storage point to a pick-up point. For home use, the common storage point is near the side or back of the home, and the pick-up point is on the street in front of the home, allowing for a commercial waste pick-up vehicle to quickly and efficiently pick up the receptacle and dump the contents by use of a mechanical arm. There are ANSI standardized sizing requirements for compatibility with such a waste vehicle. Conforming to ANSI Z245.60 Types B and G classification allow for a waste receptacle to cooperate with existing curbside collection systems.

DESCRIPTION OF THE PRIOR ART

U.S. Pat. No. 4,351,539 describes a trash barrel having a single-piece plastic container with tapered sidewalls and a bottom wall. The bottom wall is formed with a downwardly-extending pedestal along one side adapted to engage the ground, with an abutment extending laterally from the pedestal directly across the bottom wall. A pair of wheels is rotatably mounted on opposite sides of the abutment. The wheels are generally tangential to a ground plane including the lower surface of the pedestal. The wheels are also generally tangential to a place of extension of a side wall, so that the wheels lie entirely within an envelope defined by the side wall surfaces and the ground surface.

U.S. Pat. No. 4,450,976 describes a molded container with a hinged lid in which the hinge rod is partially exposed to function as a handle. Integrally molding axle bushings in the container body can support a wheeled axle. The container is characterized by a minimum number of parts which can be quickly and easily assembled after molding.

U.S. Pat. No. 4,749,101 describes a refuse container having a hinged lid pivotally supported on the ends of a transverse handle of the container body. The lid is pivotally supported on the handle by two arms extending laterally from the lid and having inward facing sockets. Two pins extending outwardly from respective ends of the handle interfit within the sockets of the lid's arms. Proximal portions of the pins are frustoconical, and the sockets are correspondingly widened at their openings. Installation and removal of the lid are accomplished simply by flexure of the lid to increase the distance between the sockets of the lid arms. The container is well suited for use with fully automated, semi-automated, and manual refuse collection systems.

U.S. Pat. No. 4,917,257 describes a garbage can comprising a barrel-like can body, which is substantially rectangular in cross-section and tapers downwardly to its bottom, a cover, which is hinged to the top rear edge of the can body, a receptacle, which is provided adjacent to the front edge of the top opening of the can body and is adapted to receive a grab claw of a lifting and tilting mechanism, and a pair of axially aligned casters, which are eccentrically mounted adjacent to the bottom of the can body. In accordance with the invention, the body of the can body is connected by an inclined wall portion of the rear wall of the can body, the inclined wall portion and the bottom of the can body are formed with laterally disposed re-entrant portions, which constitute recesses, and the casters are rotatably mounted on a common axel or on aligned stub axles fitted in holders and are disposed inside the imaginary envelope of the can body which surrounds the inclined wall portion and the recesses.

U.S. Pat. No. 5,743,542 describes a container having a pair of spaced apart flanges, through each of which a J-shaped slot extends. Each slot has an inboard end proximate the vertical centerline of the container and an outboard end positioned a greater distance from the centerline. A wheel assembly axle rod extends through the slots, and wheels are affixed to opposite ends of the axle rod. The axle rod moves between the inboard end of the slot, wherein the wheels lie within the footprint of the container sidewalls and the outboard end of the slot, wherein the wheels project rearward beyond a rearward sidewall of the container. With the wheel assembly in the inboard position, the container is nestable with a like-configured second container without interference with the wheels; and with the wheel assembly in the outboard position, the wheels are positioned outward for enhanced tipping stability and for easier support of the load carried in the container.

U.S. Pat. No. 5,758,888 describes a container and dolly assembly comprising a container having a planar rearward side and a lid that is pivotally coupled to one of the container handles and pivots thereabout into a vertical orientation against the container. Retention flanges of the container and the lid, respectively, overlap to lock the lid in the open position. The dolly is provided having upwardly directed tine members that engage flanges on the container as the container is lowered upon the dolly and latch the container and dolly together. A pivotal foot pedal is operable to laterally move one dolly tine member and thereby facilitate disengagement of both container flanges from the dolly tine members.

U.S. Pat. No. 5,865,338 describes a method of blow molding a hollow article, comprising the adaptation of a die pin to include spaced apart channels therein that extend from top to bottom along the sides of the die pin. The channels are reinforcement ribs along the inside surface of a formed parison. The ribs expand with the parison into a final form and serve to reinforce the resultant body while being visible only from the inside. The channels are each bifurcated to provide a segment below a shut-off surface in which plastic exiting the die pin can expand to form ribs of substantial thickness. Portions of the parison sidewalls between the ribs are thinned to reduce part weight, and the ribs reinforce the sidewalls to compensate, yet, being visible only from the inside, do not detract from the external appearance of the receptacle.

U.S. Pat. No. 7,712,623 describes a receptacle with a vent enabling fluid communication from a first chamber section at the bottom of the receptacle to a second chamber section which rests above the first chamber section, which reduces the suction, or vacuum, effect in the bottom portion of the receptacle as trash bags or polyliners are removed therefrom.

U.S. Pat. No. 8,757,428 describes a refuse carrying device with a variety of handling features, including an attachable secondary handle, an attachable wheel assembly, and a shoulder resting recess. The durable container has an open top adapted for receiving refuse, with opposing sides of a top edge including a pair of handles. A selectably attachable, secondary side handle, and a selectably attachable wheel assembly are positioned along an outer lower perimeter edge of the container. The shoulder recess is an indentation along the lower perimeter edge opposite the secondary handle, and includes an attachable padded cushion to line the recess.

U.S. Pat. No. 8,807,381 describes a receptacle or container for refuse that includes a body configured to receive a liner and a cinch disposed on the body. The cinch includes a projection disposed outward of the body, and is configured such that at least a portion of the liner can be disposed between the projection and the body. The cinch further includes a slot having an open end and a closed end, wherein the slot is disposed substantially adjacent the projection and configured such that at least a portion of the liner can be disposed and retained within the slot.

U.S. Pat. No. 8,973,927 describes an auxiliary rolling system for a rolling bin having a container and a set of bin wheels mounted thereon. The auxiliary rolling system comprises a frame securable to the container of the rolling bin, at least one rotatable auxiliary wheel, and a handle for controlling the auxiliary rolling system. When mounted on the rolling bin, the at least one auxiliary wheel is positioned opposite to the set of bin wheels such that the auxiliary rolling system is movable between a stationary configuration where movement of the bin is prevented, and a transport configuration where movement of the bin is allowed.

U.S. Pat. No. 9,027,778 describes a receptacle comprising a container, a first standoff, and an air-permeable support, configurable for the removal of air or atmosphere from a container while preventing solids and liquids from entering the means for removing the air.

U.S. Pat. No. 9,050,995 describes a device for transporting a plurality of refuse containers across either a support surface or a winter surface, including a housing which is partitioned into a plurality of compartments, each compartment being shaped and dimensionalized to receive a refuse container.

The above cited references are incorporated herein by reference.

Accordingly, lacking in the prior art is a way of reinforcing the strength of the handles on blow molded refuse receptacles, allowing for increased strength and durability of the overall receptacle. Also lacking in the art are additional apparatus for providing auxiliary wheels to the container for hauling heavy loads. Further lacking in the art is a blow molded trash can having compression molded portions in high wear areas for extending the life of the refuse receptacle.

SUMMARY OF THE INVENTION

The present invention relates to refuse disposal, and more particularly to a wheeled refuse receptacle which conforms to conventional industrial use sizing, whereby a drain plug allows easy removal of any liquid waste remaining in the waste receptacle, or water which accumulates due to rain or cleaning. The refuse receptacle is also sized and shaped for nestable stacking of multiple receptacles within each other with wheels fixed in position. The refuse receptacle also includes at least one retractable caster which allows heavy loads to be easily moved without tipping the refuse receptacle. Still, the refuse receptacle includes compression molded sections upon its blow molded body which provide hardened areas for high wear when compared to blow molded plastics.

Accordingly, it is a primary objective of the present invention to provide a wheeled waste receptacle including wheels recessed into the outer frame of the receptacle including a drain plug at the base of the receptacle for easy removal of fluid from within the inner chamber of the receptacle.

It is another objective of the present invention to provide a receptacle conforming to ANSI Z245.60 Types B & G classification for existing curbside collection systems.

It is yet another objective of the present invention to provide a hinging lid which opens to 270 degrees at a fully open position, based on the closed position.

It is still another objective of the present invention to provide a lower back side recess pocket for a convenient foot rest pad area, including gripper ribs integrally molded for easier tipping back of the receptacle for transport or draining.

It is a still further objective of the present invention to provide for a receptacle with a recess for an auxiliary third-wheel kit for use with larger sizes.

Still a further objective of the present invention is to provide for a receptacle as described above that can be formed by blow molding the body portion.

Yet another objective of the present invention is to provide a refuse receptacle having wheels that remain in their fixed position and still allow nested stacking of the refuse receptacle with other like constructed refuse receptacles.

Still yet another objective of the present invention is to provide a blow molded refuse receptacle having compression molded sections of the plastic to create hardened high wear areas.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 2:
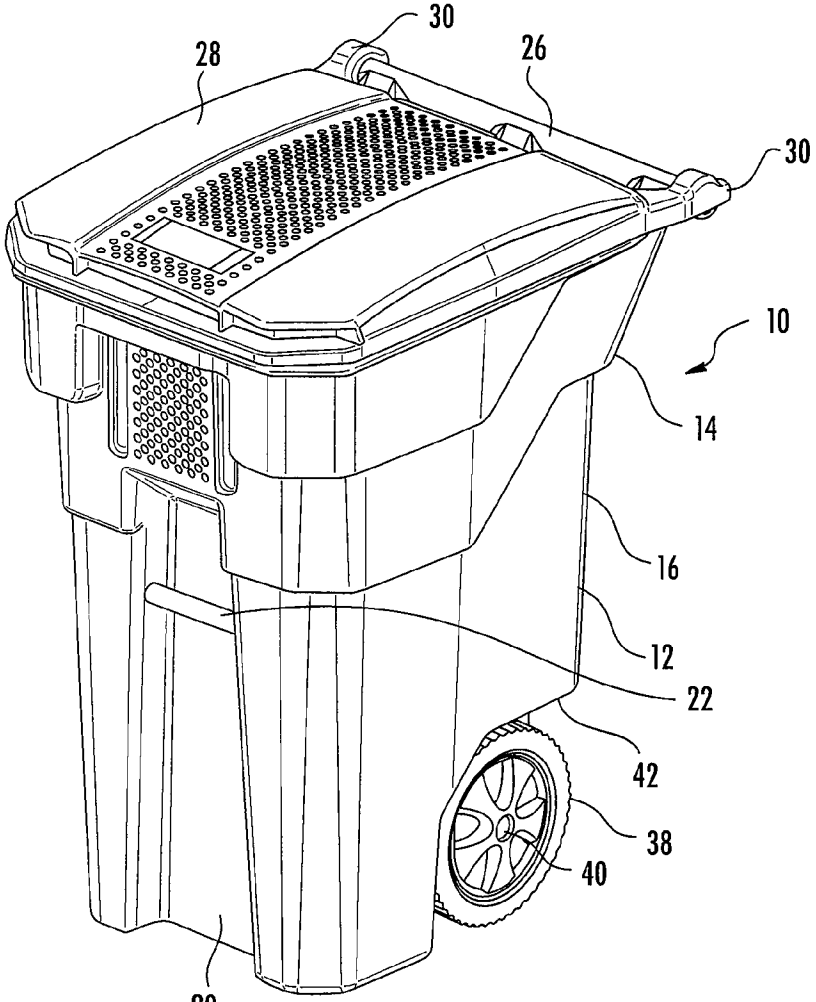
FIG. 2 is a front perspective view of the embodiment illustrated in FIG. 1.
Figure 1:
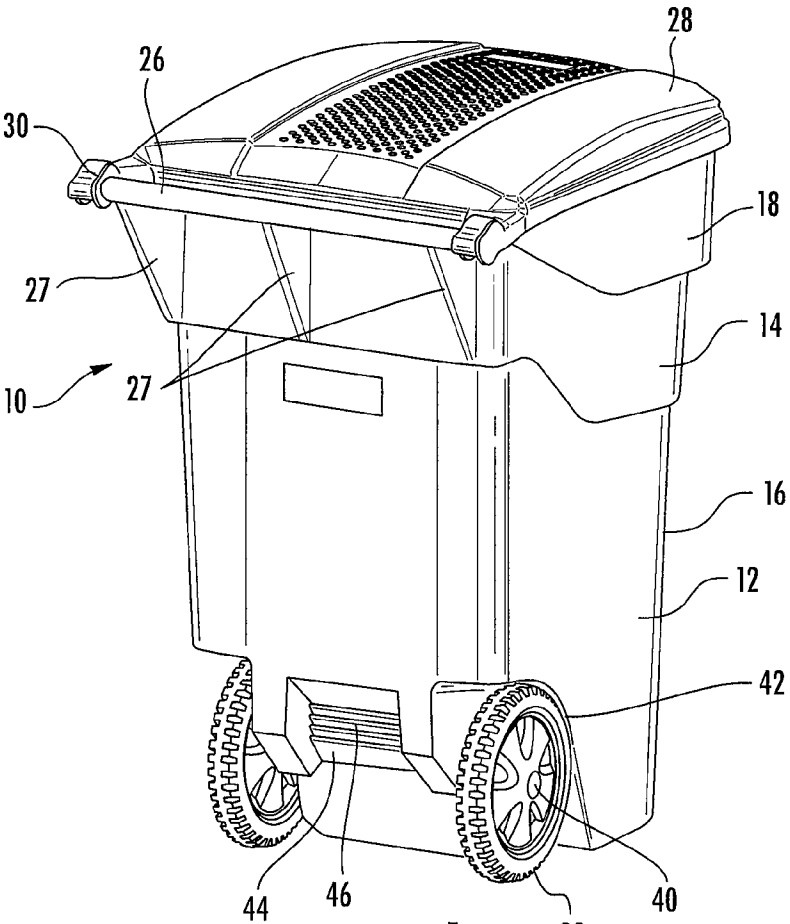
FIG. 1 is a rear perspective view of one embodiment of the refuse receptacle.
Figure 3:
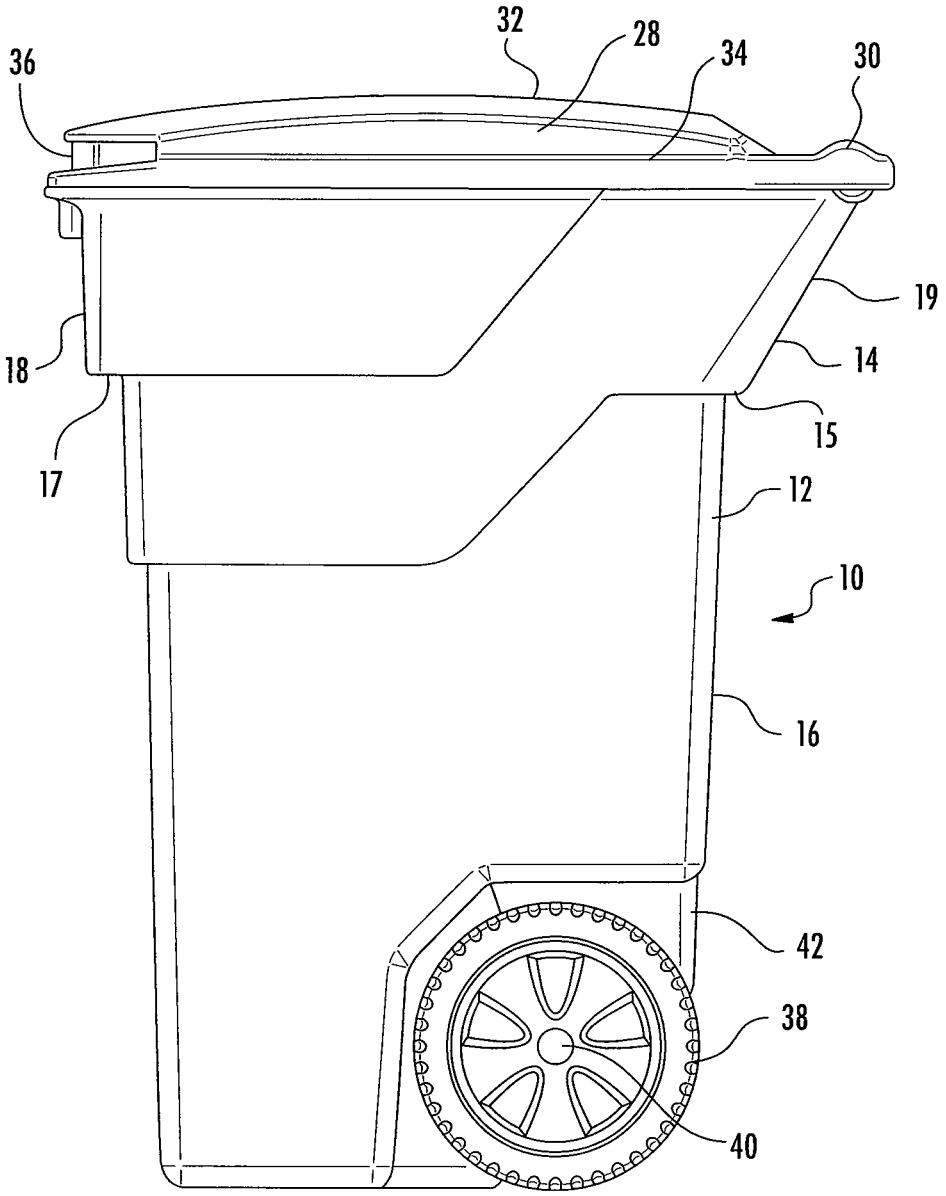
FIG. 3 is a side view of a commercial grade wheeled refuse receptacle.

As shown in FIGS. 1-7, the disclosed invention is a commercial grade wheeled refuse receptacle (10). The refuse receptacle (10) includes a body (12) with an upper portion (14), a lower portion (16) and a receiving portion (18). The front side of the body (12) includes a front channel (20) with a lift bar (22). The upper portion (14) includes a top rim (24) and a handle (26). A lid (28) attaches to the handle (26) by attachment posts (30), such that the attachment posts (30) are attached to the handle (26) and the lid rests on the top rim (24) of the receptacle.

The upper portion and lower portion are separated by a lip (15) created between the two portions. A corresponding lip defines the receiving portion, so that if one receptacle is nested within a second receptacle, the lip of the receiving portion supports the lip defining the upper portion. As shown in the preferred embodiment, each lip includes a horizontal portion (17) and an angled portion (19).

The handle (26) extends rearward from the upper portion (14) by a plurality of projections (27). The preferred embodiment has three such projections (27) to support the handle (26). The attachment posts (30) on the lid (28) can then be secured to the handle (26) by use of attachment plates (31) and a pair of screws (29) or other conventional fastening means.

Referring to FIGS. 3 and 6-9, the lid is designed with two sets of opposing vertical sidewalls (34) and an upper surface (32). The upper surface (32) is designed with a convex curve to direct rain or other fluids away from the top of the receptacle. On the front side of the lid, a lifting grip (36) is incorporated into the vertical sidewall (34). The top rim (24) is formed as a gusset with a vertical portion and a horizontal portion, so that the lid (28) rests securely on the top rim (24). As highlighted in FIG. 7, the vertical sidewalls of the lid (34) are formed to cooperate with the top rim (24) of the receptacle body (12).

Referring to FIGS. 5 and 9-15, on the lower portion of the receptacle (16) there is a wheel recess pocket (42), allowing a pair of opposing wheels (38) to fit in a recessed manner with the receptacle body. An axle (40) connects the wheels and is secured to the lower portion of the receptacle. Where the axle (40) is secured to the receptacle, there is a foot rest (44), including gripper ribs (46), allowing for a user to more easily tip the receptacle (10) backwards to be fully supported by the wheels (38). In this position, the receptacle (10) can be easily wheeled from its storage position to a pick-up position, or more generally, moved between any two or more locations.

Figure 5:
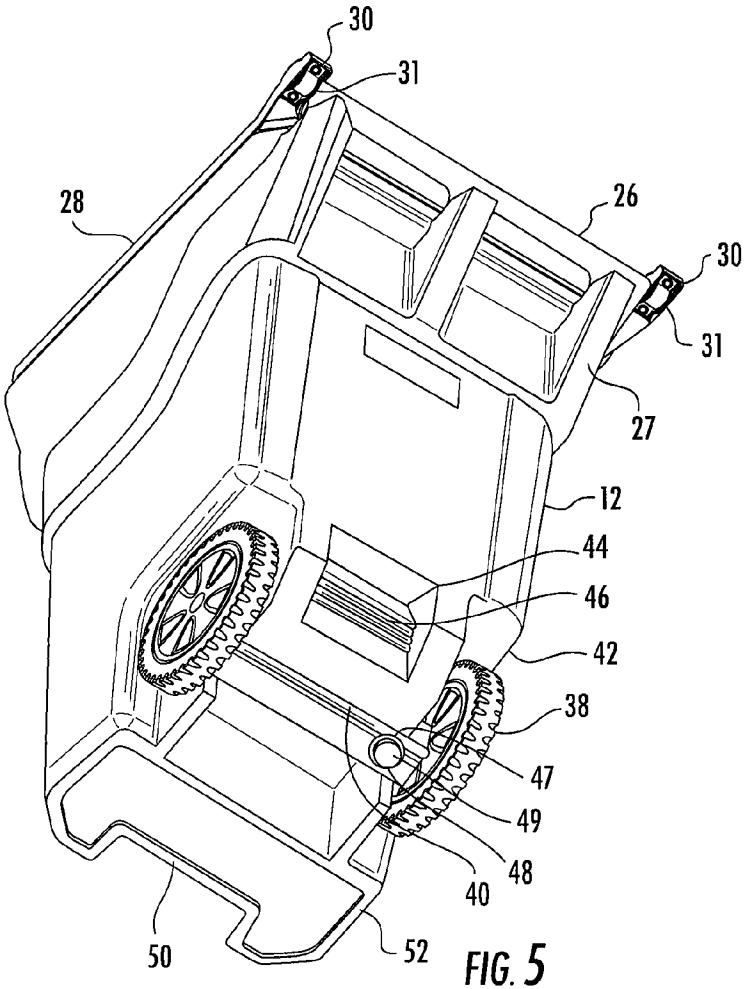
FIG. 5 is a bottom perspective view of a commercial grade wheeled refuse receptacle.
Figure 4:
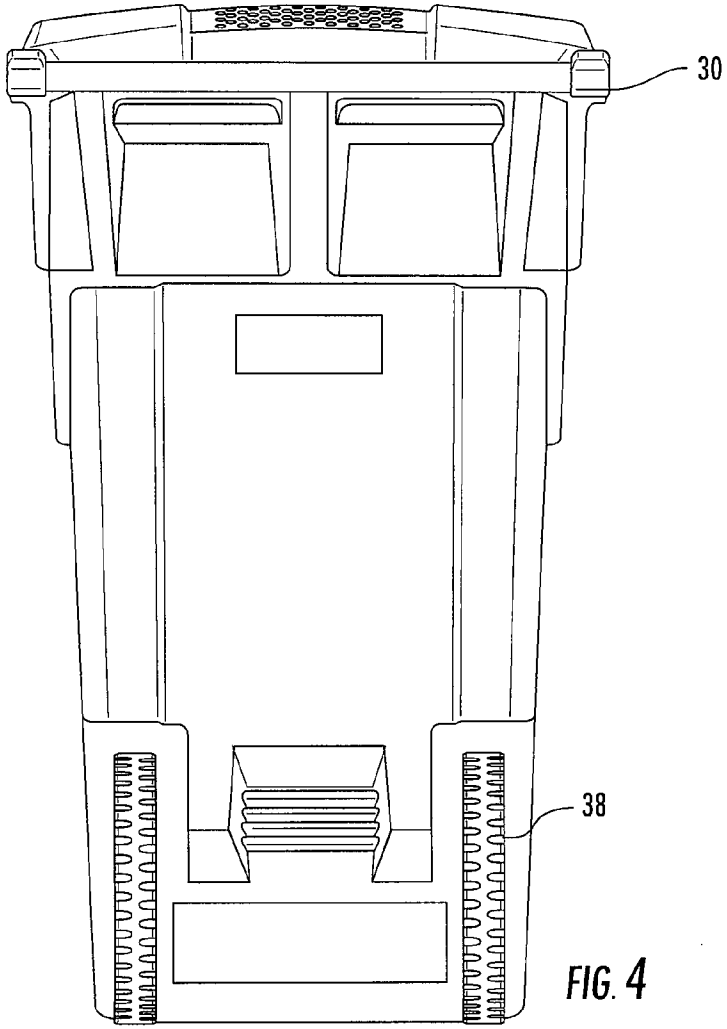
FIG. 4 is a rear view of a commercial grade wheeled refuse receptacle.
Figure 6:
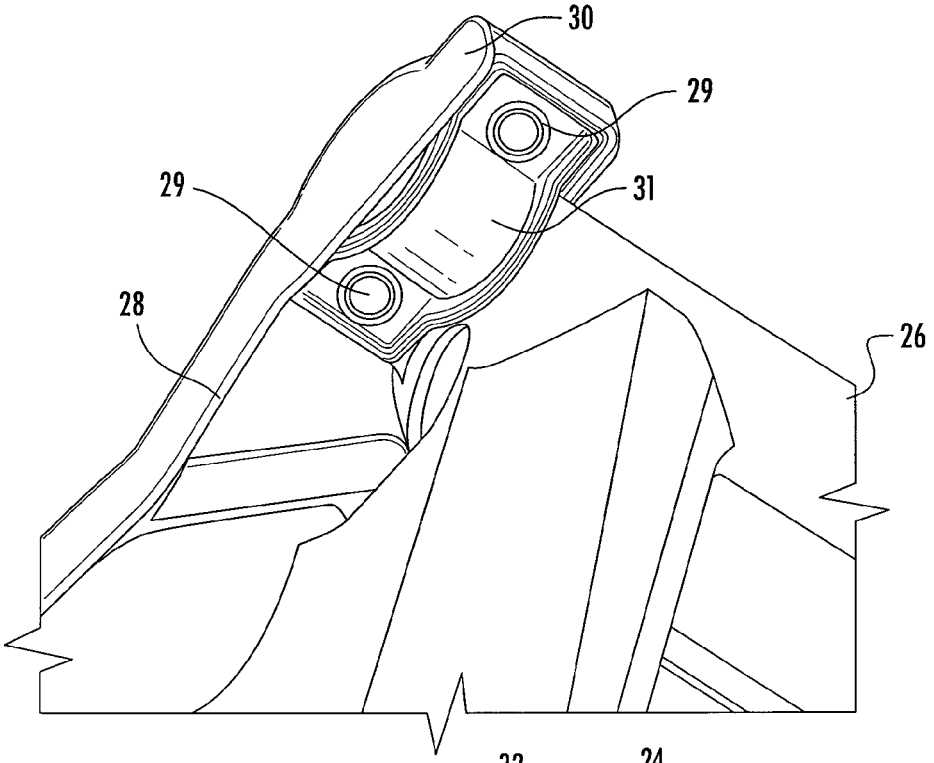
FIG. 6 is a partial perspective view illustrating the lid attachment on the commercial grade wheeled refuse receptacle.
Figure 7:
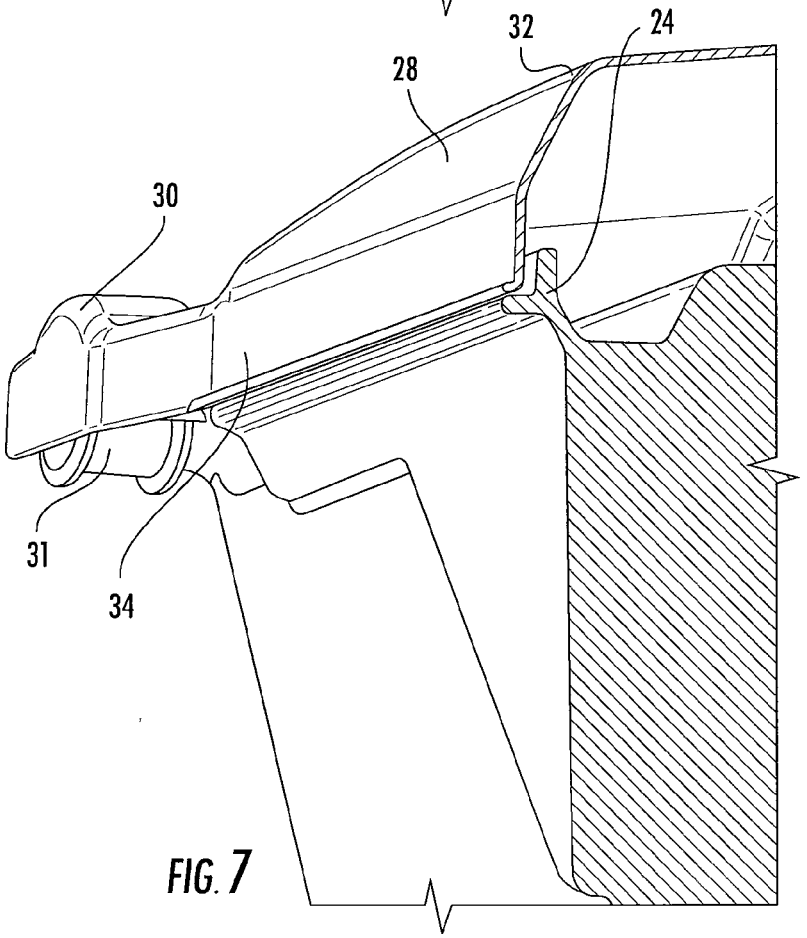
FIG. 7 is a partial perspective view of the top rim reinforced gusset.

On the bottom (50) of the receptacle, shown in FIG. 5, there is a bottom rim (52) formed by an increased thickness in the material which increases the strength and rigidity of the receptacle (10). In at least one embodiment, this portion of the refuse receptacle is compression molded during the blow molding process. Compression molding squeezes the semi-molten plastic material during the blow molding process to increase the density and thus the hardness and wear resistance of this portion of the receptacle. This construction adds wear resistance over traditional blow molding in high wear or high stress areas of the receptacle. On the lower portion (16) of the body, near the bottom rim (52) is a drainage plug (48) which comprises an aperture in a back side of said body (12). The drainage plug (48) includes a bulkhead fitting with rubber washer (47) on the outside and/or inside of said aperture, and may include a locking nut with threaded cap (49) on the outside of the aperture.

Figure 8:
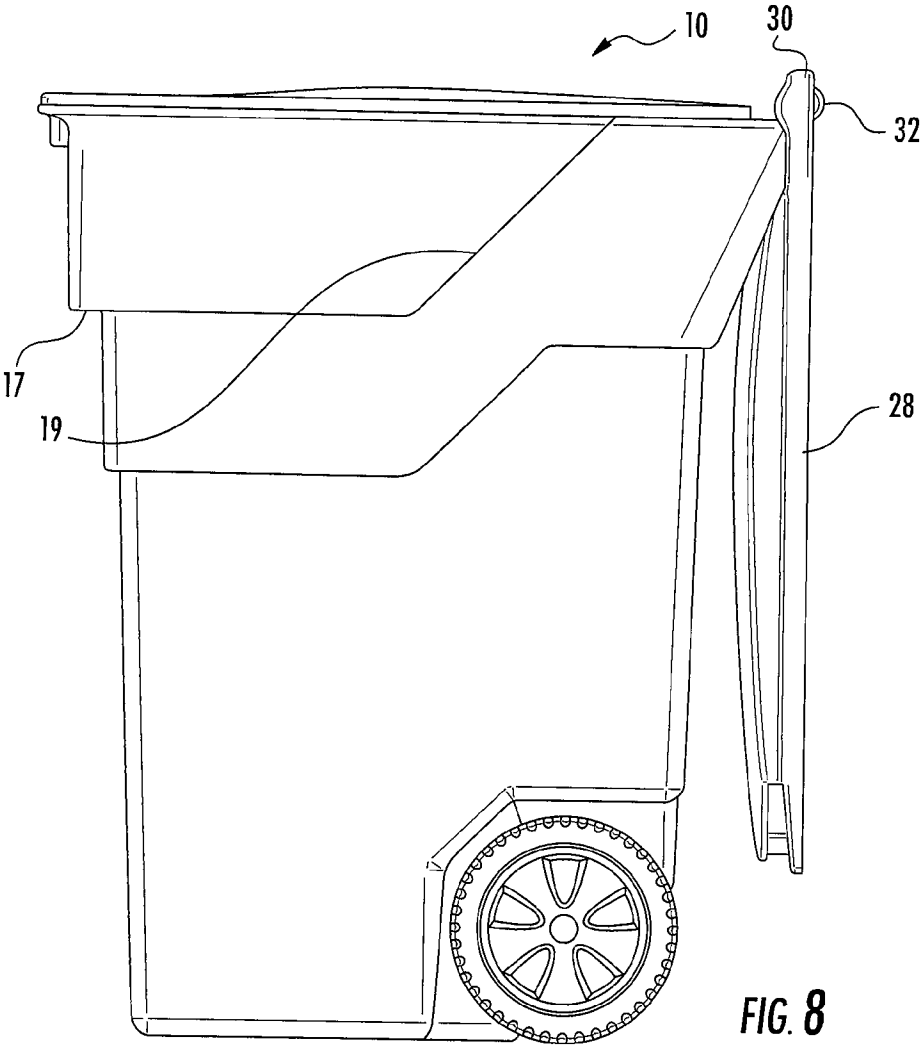
FIG. 8 is a side view of a commercial grade wheeled refuse receptacle illustrated with an open lid.
Figure 11:
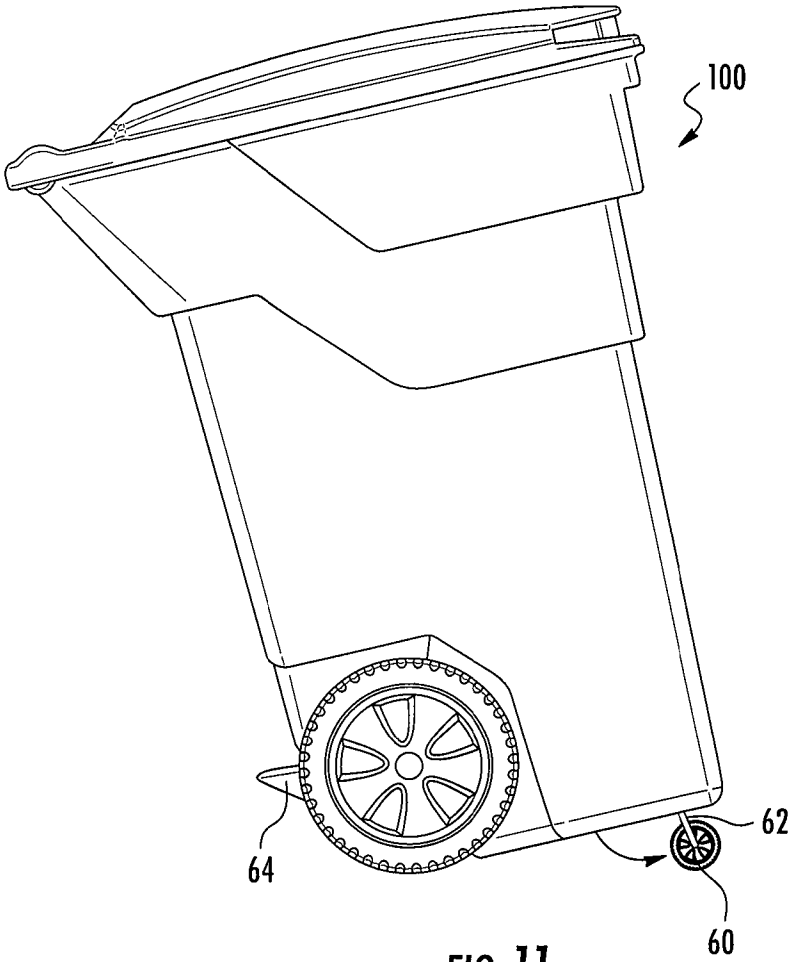
FIG. 11 is a side view of a commercial grade wheeled refuse receptacle illustrated with the optional auxiliary wheel attachment in an extended position.
Figure 10:
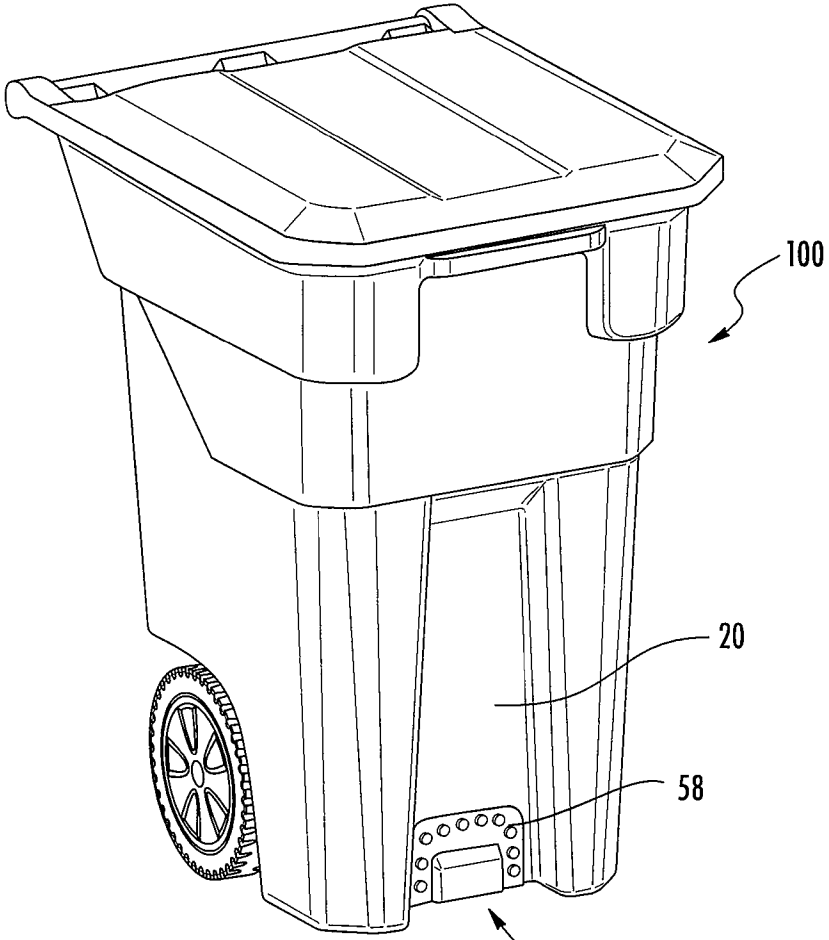
FIG. 10 is a front perspective view of a commercial grade wheeled refuse receptacle with optional auxiliary wheel attachment in a retracted position.
Figure 12:
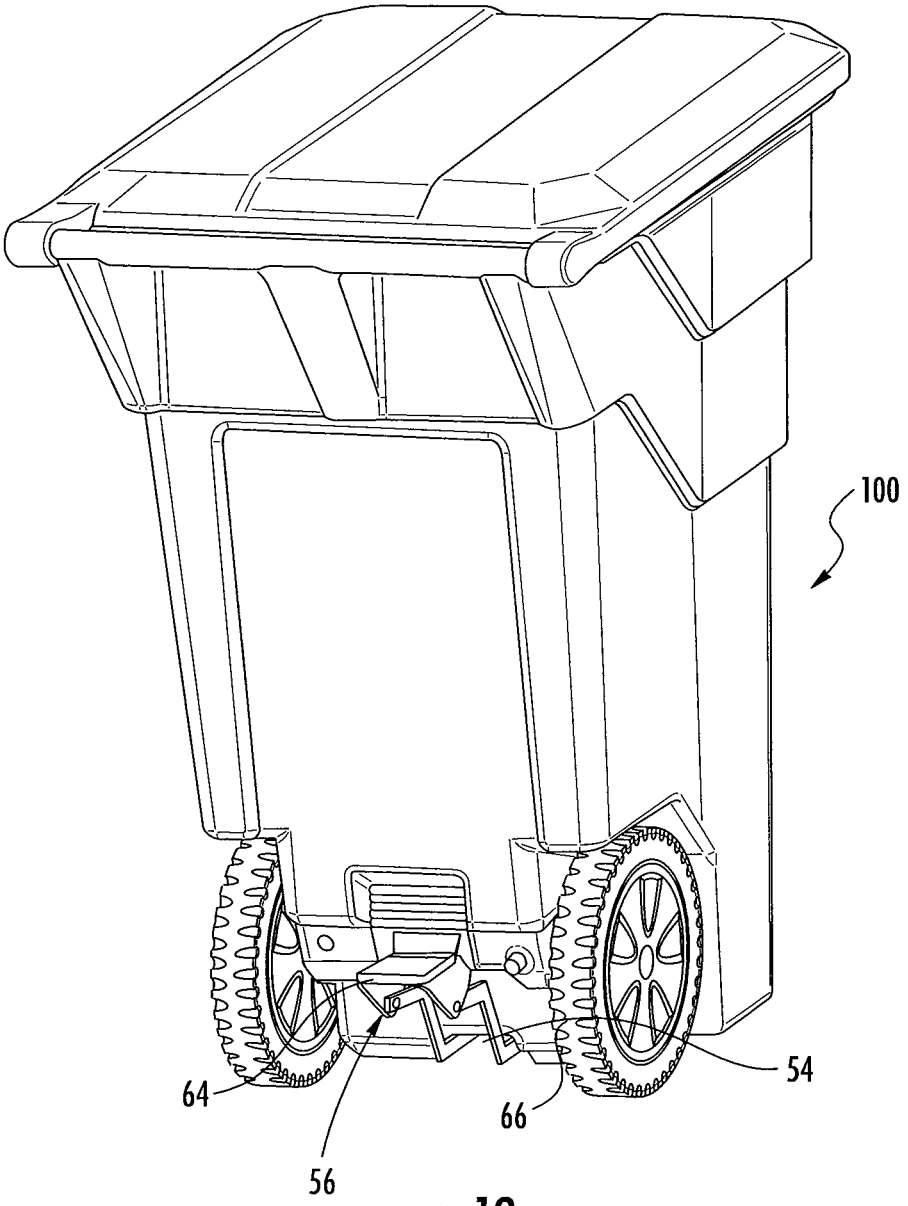
FIG. 12 is a rear perspective view of a commercial grade wheeled refuse receptacle of FIG. 10 illustrating the foot pedal for operation of the auxiliary wheel.
Figure 13:
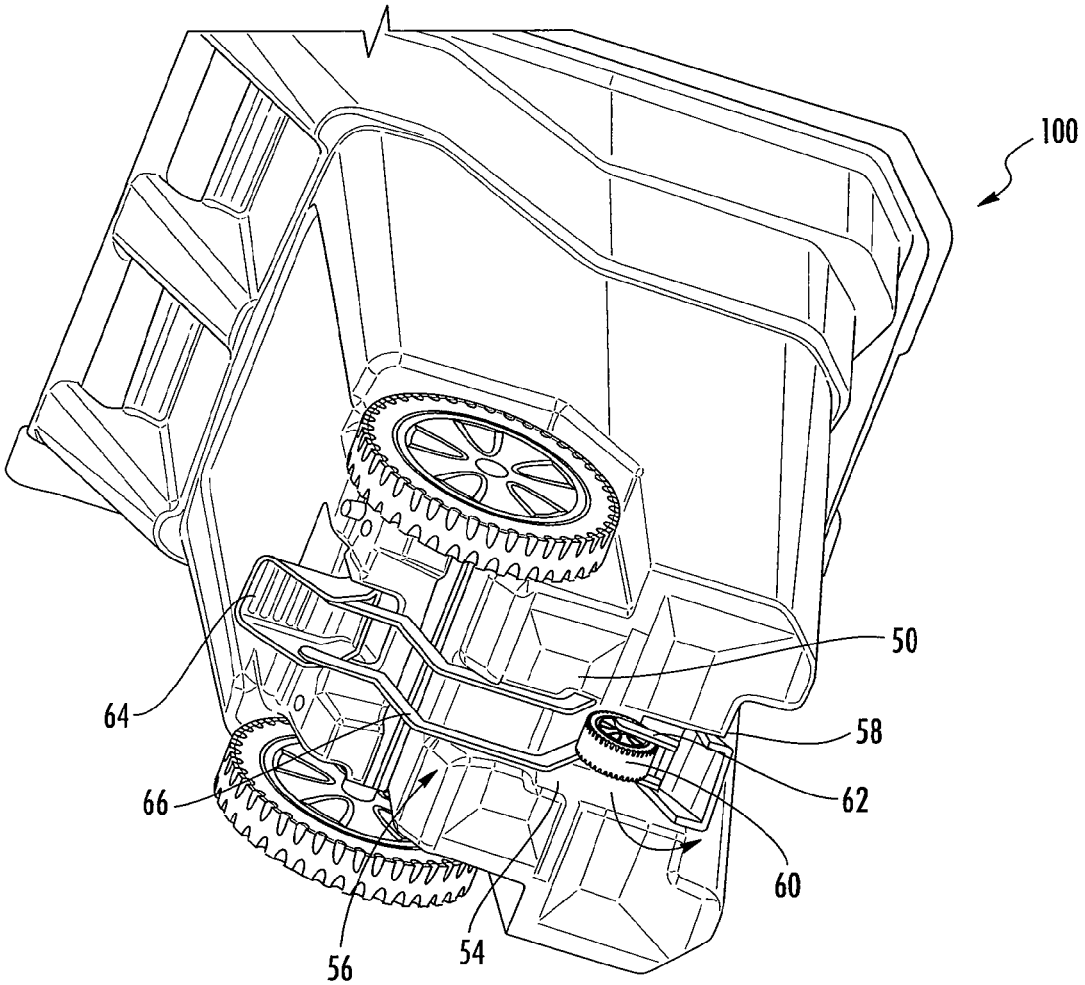
FIG. 13 is a bottom perspective view of the refuse receptacle of FIG. 10 illustrating the operations mechanism and storage compartment for the auxiliary wheel.
Figure 14A:
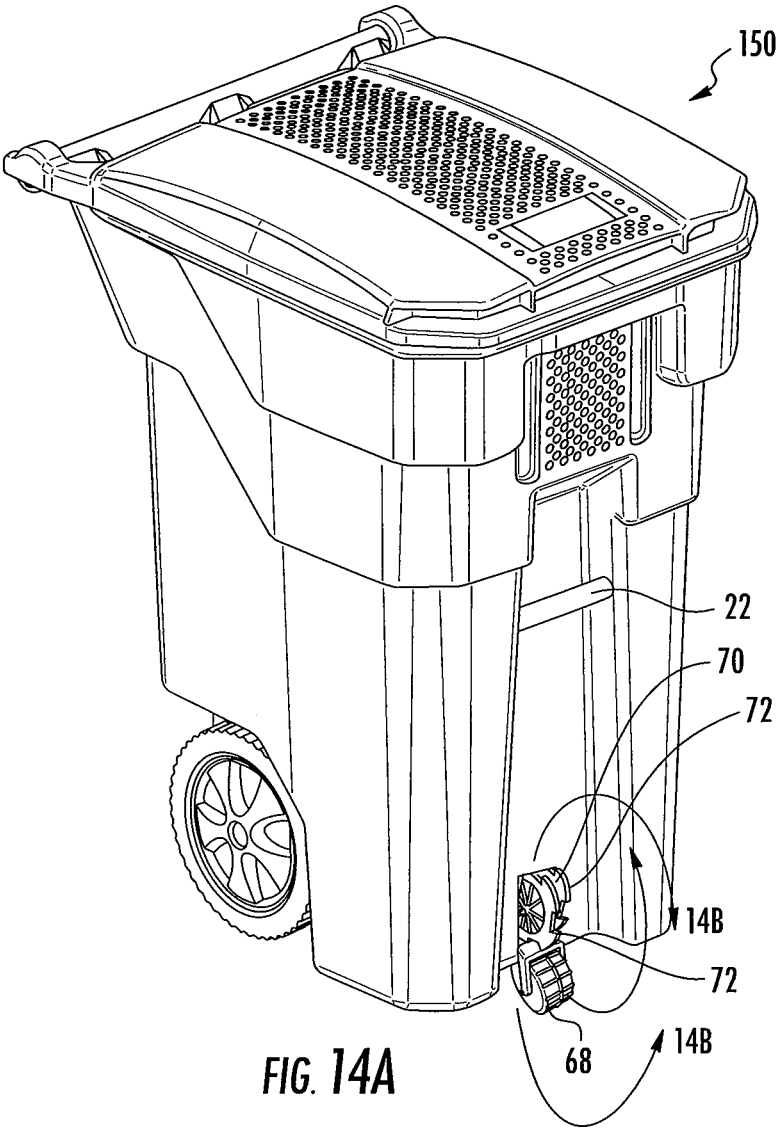
FIG. 14*a* is a front perspective view of a commercial grade wheeled refuse receptacle with a front mounting multi-position auxiliary wheel attachment.
Figure 14B:
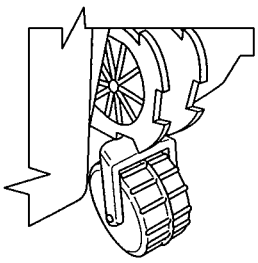
FIG. 14*b* is a partial front perspective view taken along lines 14*b*-14*b* of FIG. 14*a* illustrating the front mounting multi-position auxiliary wheel attachment in the use position.
Figure 14C:
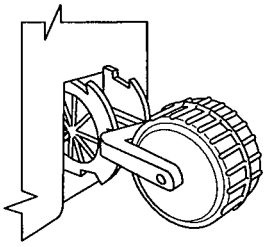
FIG. 14*c* is a partial front perspective view taken along lines 14*b*-14*b* of FIG. 14*a* illustrating the front mounting multi-position auxiliary wheel attachment in the standby position.
Figure 14D:
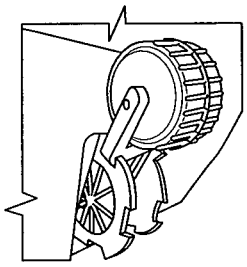
FIG. 14*d* is a partial front perspective view taken along lines 14*b*-14*b* of FIG. 14*a* illustrating the front mounting multi-position auxiliary wheel attachment in the fully retracted storage position.

Through the use of the attachment posts (30) and attachment plates (31), the lid (28) is secured to the handle (26) such that it will remain securely attached even as the lid (28) flips open to its complete open position, as shown in FIG. 8. In the fully open position, the lid (28) has rotated 270 degrees around the handle, and rests hanging vertically from the handle. The strong attachment of the lid (28) to the handle (26) is important because a refuse receptacle being used with conventional curbside pickup vehicles will experience strong forces as the receptacle is turned upside down to dump the contents into the vehicle and then return the receptacle to the curbside.

Figure 9:
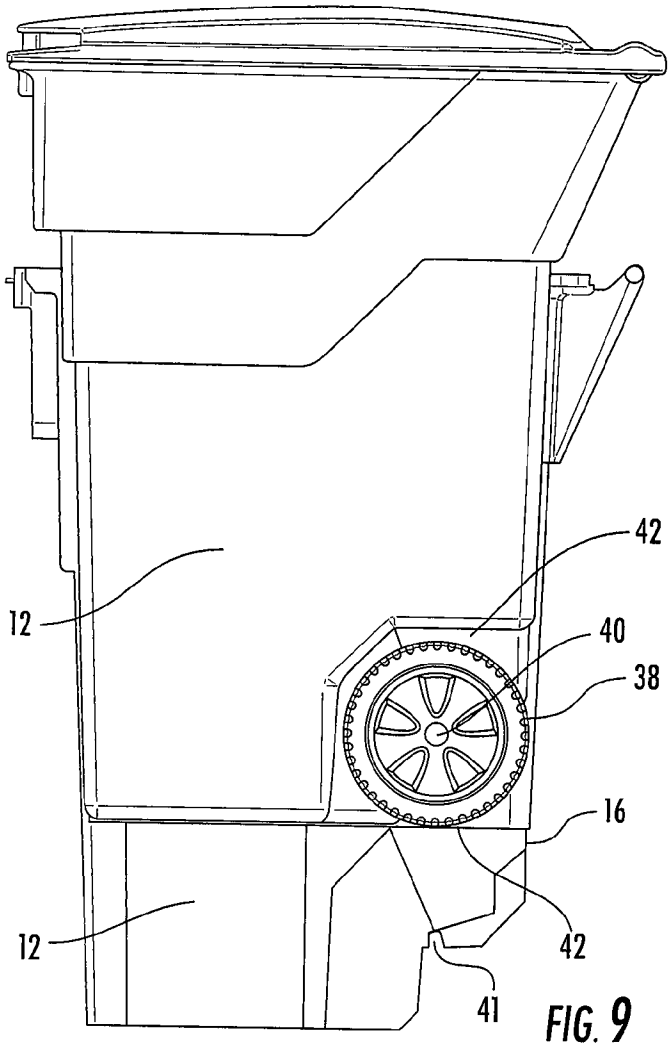
FIG. 9 is a side view, partially in section, depicting the nesting storage of commercial grade wheeled refuse receptacles, the inner refuse receptacle having the wheels in place.

FIG. 9 shows how the recessed wheel pocket (42) allows multiple wheeled receptacles (10) to be stored in a nested configuration with respect to each other for compact storage and transportation. Because the wheel recess pocket (42) brings the wheel within the footprint of the rectangular lower portion perimeter, the wheeled receptacle can fit within another receptacle even with the wheel (38) and axel (40) attached. Also shown, there is an axel cutout (41) generated during the formation of the body (12). This allows the axel (40) and wheels (38) to be attached to the receptacle after formation of the body. In this way, the body can be formed by blow molding the parison into the shape and later attaching the axel (40) and wheels (38).

FIGS. 10-13 illustrate an alternate receptacle (100), including an auxiliary wheel kit (56). The auxiliary wheel kit (56) includes a front mounting plate (58) which attaches in the front channel (20) of the body (12). In this embodiment, the bottom (50) includes an auxiliary wheel channel (54) to allow for the auxiliary wheel kit to be added onto the receptacle (100). This is beneficial with larger sized receptacles because the additional auxiliary wheel (60) helps transport the heavier loads with increased balance and safety. The retractable nature of the wheel assembly allows the refuse receptacle to be shipped and stored in a nested position within other like constructed refuse receptacles.

FIGS. 14*a*-14*d* illustrate an alternate receptacle (150) with a front mounting auxiliary wheel (68). As shown, the auxiliary wheel (68) is attached by a mounting portion (70) which mounts to the receptacle body (12) in the front channel (20) so that the mounting portion (70) is recessed within the front channel (20). The mounting portion has notches (72), allowing for multiple positions of the auxiliary wheel (68). A user can use the lift bar (22) to tilt the receptacle backwards and move the auxiliary wheel into the engaged position, shown in FIGS. 14*a* and 14*b*, where the wheel helps support the weight of the receptacle (150). When not engaged, the auxiliary wheel can either be in a standby position, shown in FIG. 14*c*, or in a retracted position, shown in FIG. 14*d*.

Figure 15B:
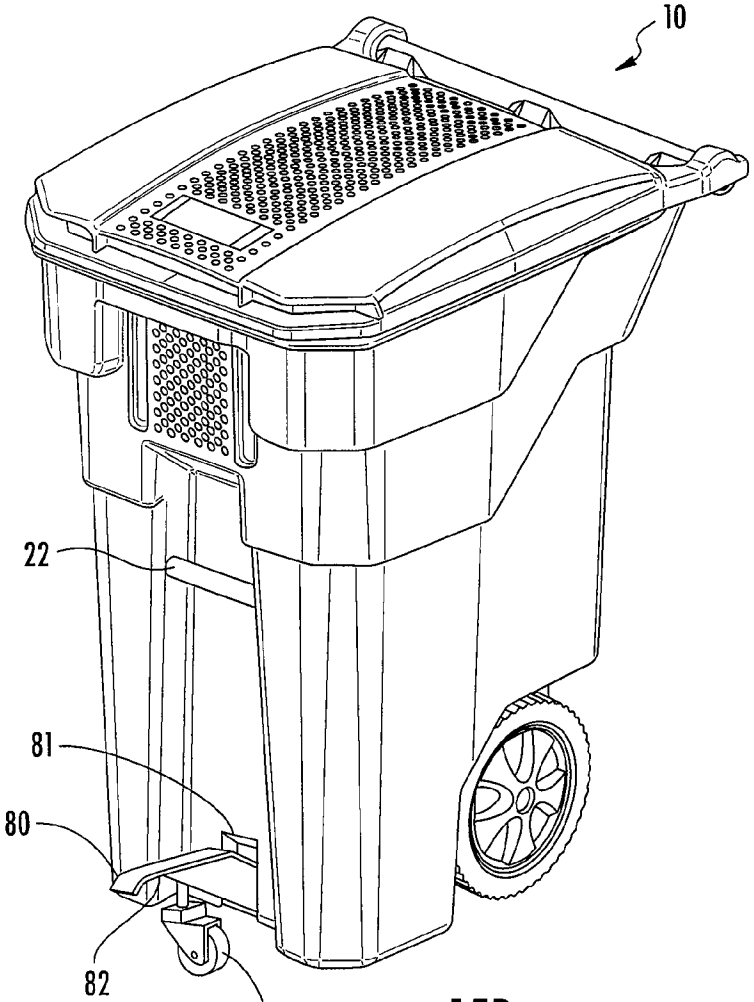
FIG. 15*b* is a front perspective view of a commercial grade wheeled refuse receptacle with front mounting foot actuated auxiliary wheel in the standby position.
Figure 15A:
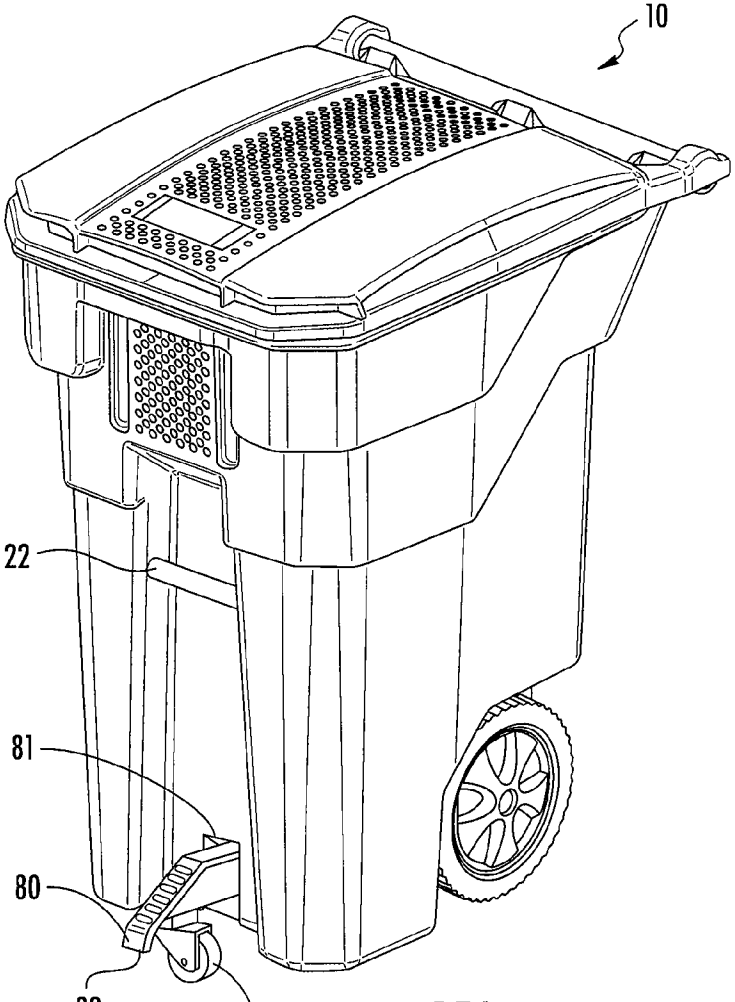
FIG. 15*a* is a front perspective view of a commercial grade wheeled refuse receptacle with front mounting foot actuated auxiliary wheel in the engaged position.

FIGS. 15*a* and 15*b* show a receptacle (10) with a foot actuated front auxiliary wheel assembly (80). The assembly includes a mounting plate (81) which attaches to the receptacle body (12) in the front channel (20). To engage the front auxiliary wheel (84), a user presses down on the foot lever (82) while lifting the lift bar (22) to tilt the receptacle (10) slightly towards the rear wheels (38). The assembly (80) can be included as an added piece, to be attached prior to sale of the receptacle (10), or later if a user finds he desires the added auxiliary wheel.

Because the lid and wheels are attachable additions to the body of the receptacle, the body is able to be formed by blow molding. After the body is formed, the lid can be attached to the handle, and the wheels and axel can be attached. The drainage plug can be formed and sealed as this point, or the aperture can be formed during the extrusion process, and then the sealing components can be added after formation. Finally, an auxiliary wheel can be added if desired.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A refuse receptacle comprising:

a body, said body having an upper portion and a lower portion integrally joined to each other, said lower portion having a bottom side and a base rim, said upper portion having a top rim, said top rim forming a gusset with a vertical wall and a horizontal wall, said body including a first lip between said lower portion and said upper portion, said body including a second lip in said upper portion, said second lip constructed and arranged so that a second refuse receptacle can be positioned within said body and said second lip supporting said second refuse receptacle;

a handle integrally joined to said upper portion of said body on a back side, said handle having a gripping portion connected to said body by at least one projecting sidewall;

a recessed foot rest on said lower portion of said body on a back side, said foot rest having gripper ribs for increased traction, said foot rest allowing for said receptacle to be more easily tipped towards said back side;

a lid corresponding to said top rim of said body, said lid having a convex upper side and two sets of opposing sidewalls, said opposing sidewalls forming a lower rim, said lower rim corresponding to said body top rim gusset, said lid having at least one hinged attachment projecting from one of said opposing sidewalls and attaching to said handle;

a drainage plug on said body lower portion on said back side for removing liquids contained within said receptacle body; and a pair of wheels attached to said lower portion of said receptacle body by at least one axle, said at least one axle attached to said lower portion through each of said wheels located within a wheel recess whereby each of said wheels is located within an outer area of said lower portion;

wherein at least part of said refuse receptacle is formed by compression molding of an extruded parison while the remainder of the receptacle is formed by the process of blow molding.

2. The refuse receptacle of claim 1, wherein said body includes a front side, said front side of said body lower portion having a front channel to allow for a lift bar corresponding to existing curbside collection systems.

3. The refuse receptacle of claim 2, wherein said body conforms to ANSI Z245.60 Types B & G classification for curbside collection systems.

4. The refuse receptacle of claim 1, wherein said body is tapered to allow for nesting of said lower portion within a second receptacle.

5. The refuse receptacle of claim 1, wherein said lid contains at least one attachment projection, said at least one attachment projection attached to said handle with at least one securing member and at least one fastener.

6. The refuse receptacle of claim 5, wherein said fastener is at least one screw.

7. The refuse receptacle of claim 1, wherein said drainage plug comprises a bulkhead fitting with a rubber washer on the inside of said aperture, and a locking nut with threaded cap on the outside of said aperture.

8. The refuse receptacle of claim 1, further comprising a front wheel, said front wheel hingedly secured to said body.

9. The refuse receptacle of claim 8, wherein said front wheel is positioned within a channel on said bottom side of said body and hingedly attached to a mounting plate secured to said body, said front wheel movable between a retracted position and an extended position, said front wheel in said retracted position being recessed within said bottom side channel such that said front wheel does not extend below a plane formed by said base rim, said front wheel moving between said retracted position and said extended position by force applied to a foot pedal located on said back side of said lower portion.

10. The refuse receptacle of claim 8, wherein said front wheel is secured to a front mounting plate secured to said lower portion of said body in said front channel, said front wheel movable between at least an engaged position where said front wheel partially supports said receptacle and a retracted position where said front wheel is retracted within said front channel.

11. The front wheel of claim 10, wherein said front wheel further includes a standby position.

12. The refuse receptacle of claim 8, wherein said front wheel is connected to a lever, said lever connected to a front mounting plate, said front mounting plate secured to lower portion of said body in said front channel, said front wheel movable between an engaged position where said front wheel partially supports said receptacle and a disengaged position where said front wheel does not support said receptacle.

13. The refuse receptacle of claim 1 wherein said portion of said refuse receptacle that is compression molded is a bottom rim portion.

14. The refuse receptacle of claim 1 wherein said portion of said refuse receptacle that is compression molded is a handle support portion.

* * * * *